US007156788B1

(12) United States Patent
Jackson et al.

(10) Patent No.: US 7,156,788 B1
(45) Date of Patent: Jan. 2, 2007

(54) EXERCISE APPARATUS

(76) Inventors: Coley Barry Jackson, 2202 Timberbrook La., Midway Park, NC (US) 28544; Dominga Jackson, 2202 Timberbrook La., Midway Park, NC (US) 28544

( * ) Notice: Subject to any disclaimer, the term of this patent is extended or adjusted under 35 U.S.C. 154(b) by 0 days.

(21) Appl. No.: 10/908,035

(22) Filed: Apr. 26, 2005

Related U.S. Application Data

(60) Provisional application No. 60/567,610, filed on May 3, 2004.

(51) Int. Cl.
*A63B 26/00* (2006.01)
*A63B 71/00* (2006.01)

(52) U.S. Cl. ..... 482/141; 482/907; 248/121

(58) Field of Classification Search ..... 482/104, 482/141, 23, 148, 14, 79, 907; 248/49, 121, 248/126–127, 346.01
See application file for complete search history.

(56) References Cited

U.S. PATENT DOCUMENTS

| | | | | |
|---|---|---|---|---|
| 1,177,473 | A * | 3/1916 | Bathrick | 482/87 |
| 3,682,475 | A * | 8/1972 | Walker | 482/140 |
| 4,332,381 | A * | 6/1982 | Lyons | 482/140 |
| 4,620,701 | A * | 11/1986 | Mojden | 482/41 |
| 4,655,448 | A * | 4/1987 | Harder | 482/142 |
| 4,709,923 | A * | 12/1987 | Gibson | 482/138 |
| 5,582,565 | A * | 12/1996 | Soria | 482/141 |
| 6,220,992 | B1 * | 4/2001 | Shafik | 482/83 |
| 6,484,986 | B1 * | 11/2002 | Kolodzieski | 248/237 |

* cited by examiner

*Primary Examiner*—Lori Amerson
(74) *Attorney, Agent, or Firm*—John F. Bohland

(57) ABSTRACT

A portable exercise apparatus for push-ups and body presses. Longitudinal adjustments accommodate a wide range of physical dimensions of users, and multiple lateral adjustments allow a wide range of lateral adjustments in a compact space. Independently adjustable foot and hand supports allow the user to select a longitudinally or laterally inclined attitude for the user's body during an exercise routine.

9 Claims, 5 Drawing Sheets

EXERCISE APPARATUS

This application claims priority to pending provisional application 60/567,610, which was filed on May 3, 2004 and is hereby incorporated by reference.

FIELD OF INVENTION

The present invention relates to exercise equipment particularly suited for push-up and body press exercises.

BACKGROUND

The push-up is a versatile exercise practiced in many different variations. The traditional push-up developed as an exercise to be executed in a substantially prone position on the ground, floor, or other horizontal surface. Many different devices have been developed to aid in particular aspects of the push-up exercise.

U.S. Pat. No. 5,226,868 describes a push-up board that provides two hand supports that may be inserted into any one of a plurality of holes in the board to provide a selectable distance between the hand supports. The hand supports are also rotatable to provide a comfortable position for the user. However, this apparatus does not provide a foot support and does not provide height adjustments for the hand supports.

U.S. Pat. No. 5,205,802 provides a base with holes to accommodate hand supports at selectable distances from the center. The hand supports are rotatable, but the heights of the hand supports are not adjustable. This device does not provide a foot support.

U.S. Pat. No. 6,186,930 describes a push-up trainer having a base and a pair of handgrip assemblies. The handgrip assemblies are each mounted to the base, allowing for lateral movement of the handgrips. Each handgrip assembly allows for rotation of each handgrip around a vertical axis and around its horizontal lengthwise axis. Each of the sliding and rotational motions may selectively be allowed or locked out using a spring-biased pin. However, this apparatus does not provide a foot support and does not provide height adjustments for the hand supports.

U.S. Pat. No. 6,716,145 describes a push-up/chest exercising device with movable handhold members, but this device does not provide a foot support or height adjustments for the handhold members.

U.S. Pat. No. 6,050,926 describes a push-up device with a series of aperture pairs, such that two wooden dowels can be positioned through respective aperture pairs to establish respective hand holds for the left and right hands of a user. The lateral distance between handholds is variable, but no height adjustment is provided. Also, this apparatus does not provide a foot support.

U.S. Pat. No. 6,048,294 discloses an exercise apparatus comprising an elongated generally C-shaped bar with an elongated back portion and a pair of opposing curved end portions. The device provides a variety of different hand gripping positions for doing push-ups, but it does not allow height adjustments and does not provide foot supports.

U.S. Pat. No. 5,004,229 shows a rolling foot support devise that may be used with or without a variety of hand support devices to perform various exercise routines. This device does not provide an integrated structure with hand and foot supports and does not provide height adjustments for hand supports.

U.S. Pat. No. 5,582,565 describes a triceps exercise apparatus comprising a single horizontal bar providing handgrip areas for both hands. The height of the bar is adjustable, but the right and left hand grips are not individually adjustable. The apparatus includes a block for receiving the feet of the user and means for manually adjusting the distance of the block from the bar so as to adjust the apparatus to users of differing heights. However, the triceps exercise apparatus is not specially suited for portability.

SUMMARY OF THE INVENTION

It is an object of the present invention to provide an exercise apparatus that breaks down for easy portability.

It is a further object of the present invention to provide a push-up exercise apparatus that supports the user's body in a substantially prone position.

It is also an object of the present invention to provide independently adjustable foot and hand supports, thereby allowing the user's body to be selectively inclined longitudinally or laterally.

It is also an object of the present invention to provide a push-up apparatus that fully supports the user's body above the floor level.

The exercise device of the present invention has a combination of telescoping sleeves and slidable hand supports to provide greater latitude in positioning. Additionally, the hand supports are offset so that they are positionable on either side of a transverse structural member, effectively extending the range of longitudinal adjustment.

DETAILED DESCRIPTION

Figure 1:
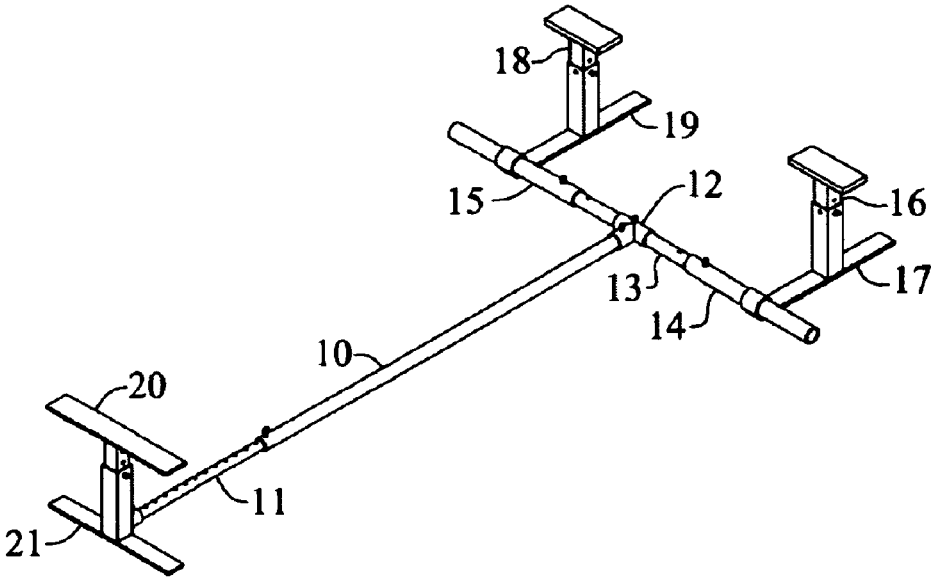
FIG. 1 is a view of an exercise apparatus according to the present invention with hand support assemblies configured to provide maximum distance between hand supports and the foot support.
Figure 2:
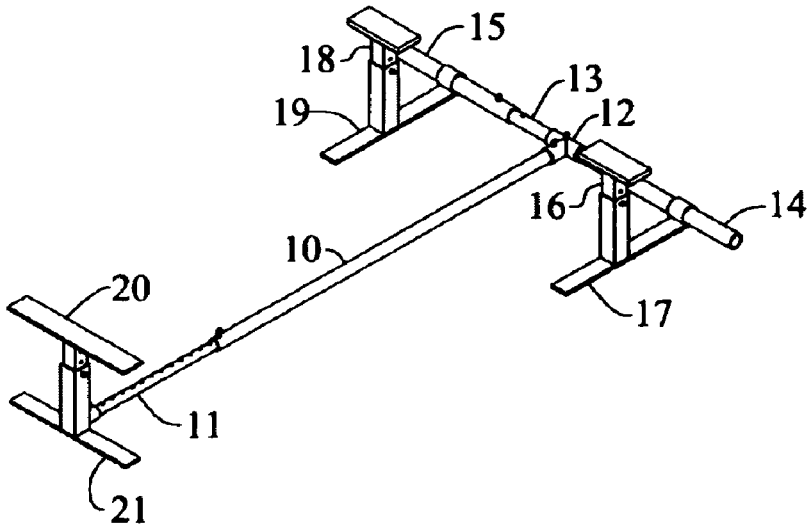
FIG. 2 is a view of an exercise apparatus according to the present invention with hand support assemblies configured to provide minimum distance between hand supports and the foot support.
Figure 3:
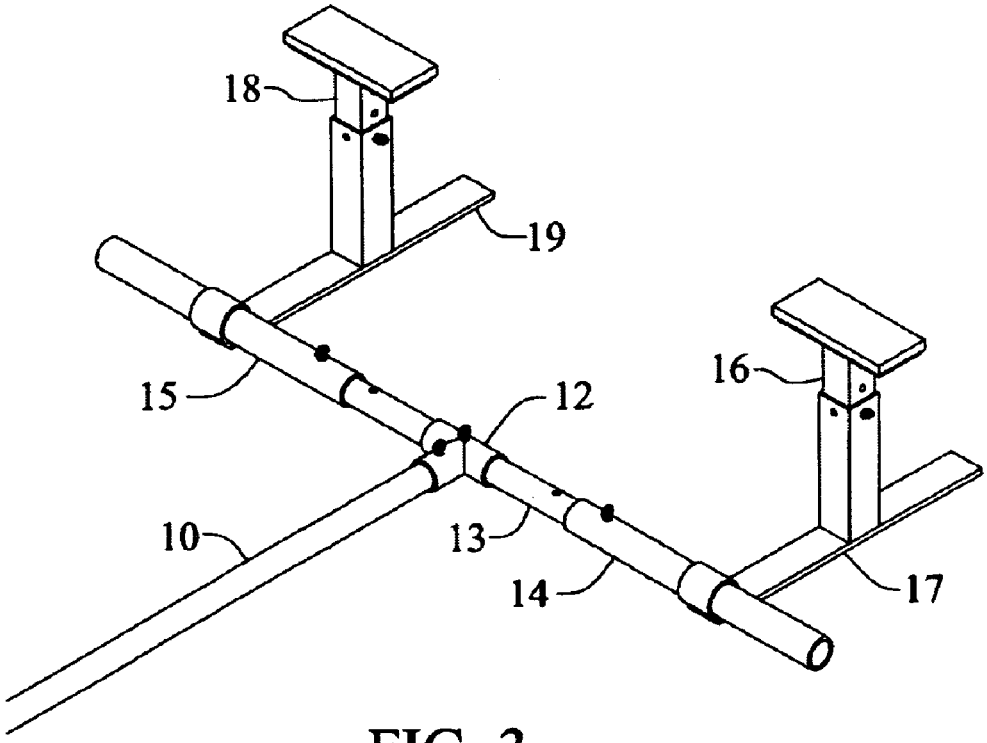
FIG. 3 is a close-up view of the head end of an exercise apparatus according to the present invention with the hand supports laterally oriented.
Figure 4:
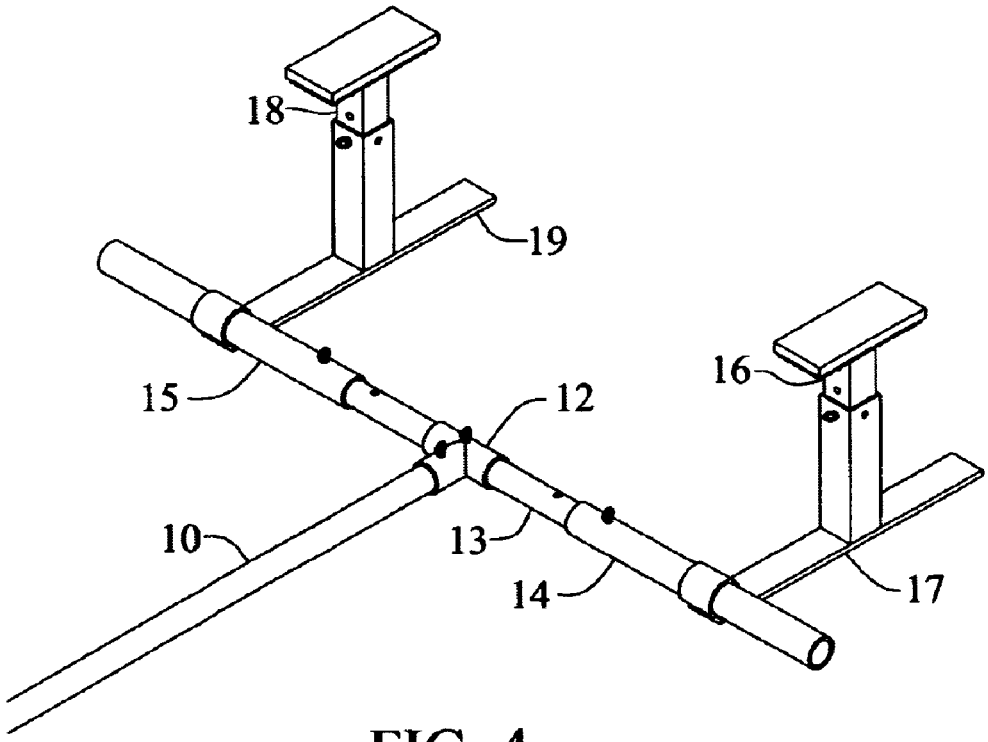
FIG. 4 is a close-up view of the head end of an exercise apparatus according to the present invention with the hand supports longitudinally oriented.
Figure 5:
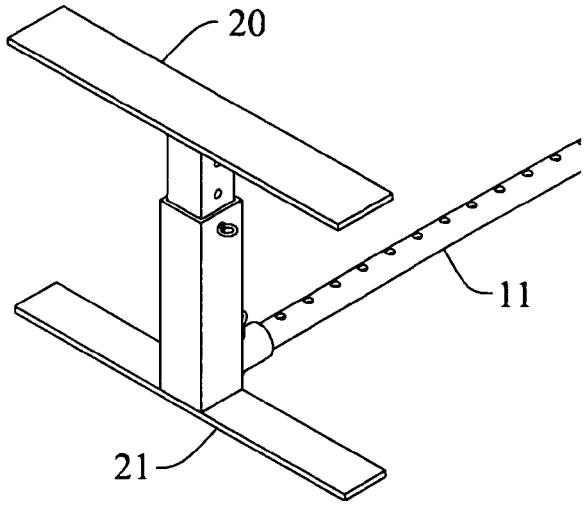
FIG. 5 is a close-up view of the foot end of an exercise apparatus according to the present invention.

In a preferred embodiment, an exercise apparatus according to the present invention is configured as shown in the attached figures.

Referring to FIGS. 1–5, a telescoping assembly comprising an outer longitudinal elongated member (10) and an inner longitudinal elongated member (11) provides a means for adjusting the length of the apparatus to accommodate different size users or the requirements of different exercise routines. A T-connector (12) connects the outer longitudinal member to a lateral elongated member (13). A right sleeve (14) and a left sleeve (15) telescope on the right and left ends of the lateral member to provide lateral adjustment. A right hand support (16) fits into a right base (17), and in a similar manner, a left hand support (18) fits into a left base (19). The right and left bases slide on the right and left sleeves to provide additional lateral adjustment. A foot support (20) fits into a foot support base (21), which is connected to the inner longitudinal member (11).

Figure 6:
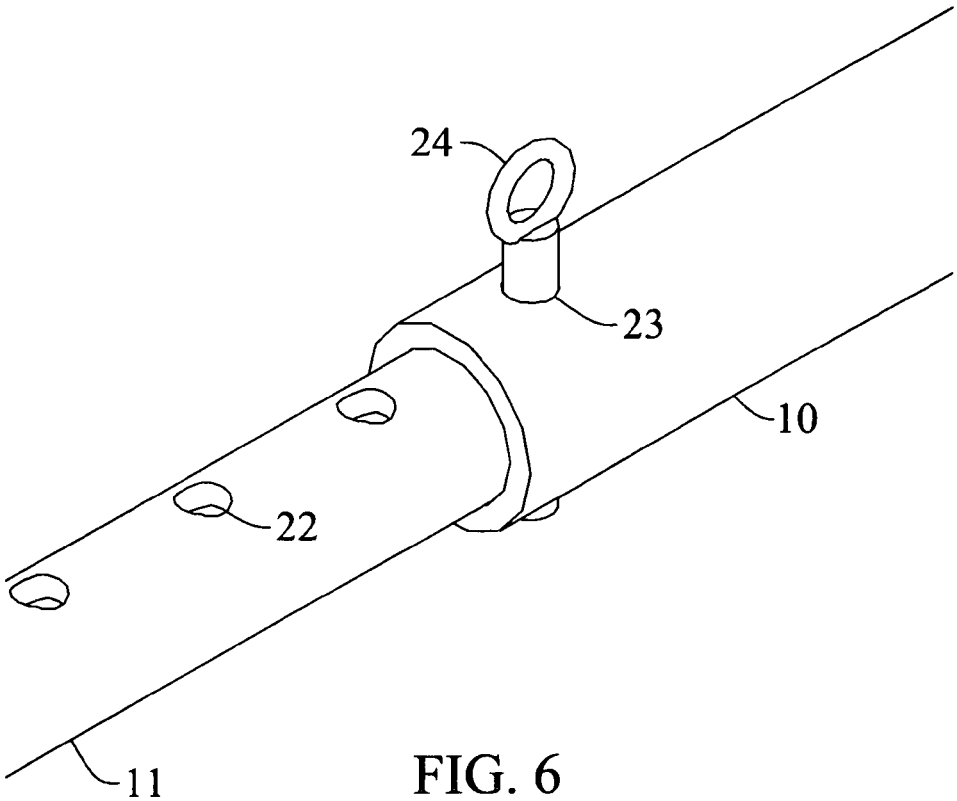
FIG. 6 is a close-up view of the junction between the inner and outer longitudinal members.

As shown in FIG. 6, a plurality of inner longitudinal member apertures (22) are engageable with an outer longitudinal member aperture (23) using a longitudinal adjustment pin (24), thereby providing means for adjusting the length of the exercise apparatus.

Figure 7:
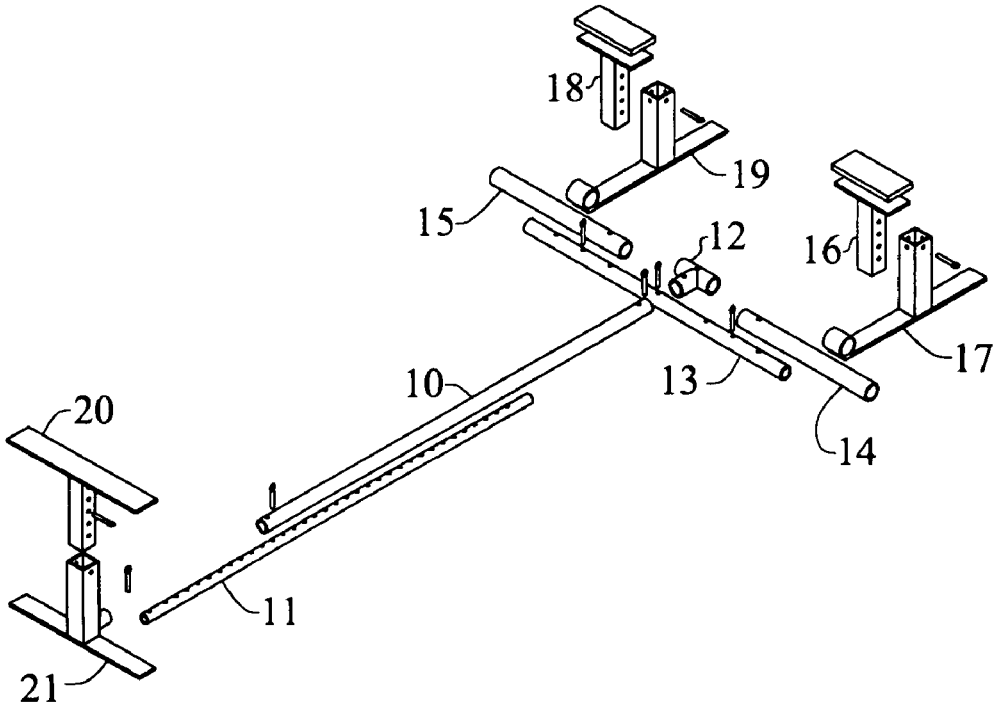
FIG. 7 is an overall view of an exercise apparatus according to the present invention with the components separated.

The entire apparatus is shown in the unassembled state in FIG. 7.

Figure 8:
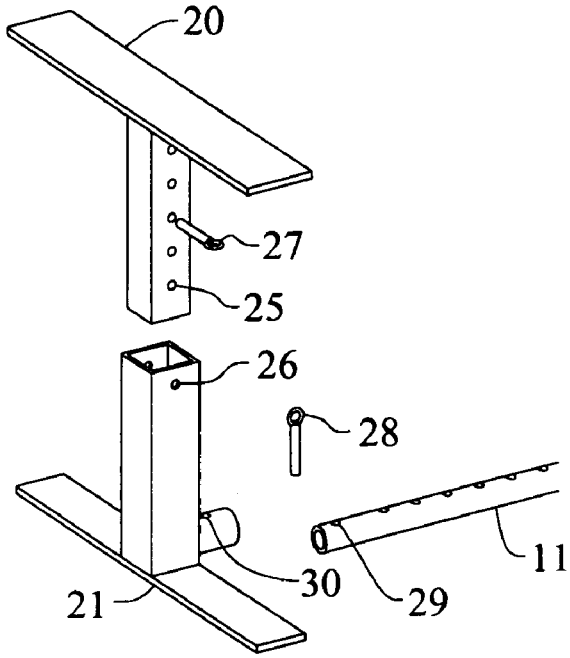
FIG. 8 is a close-up view of the separated components of the foot end of an exercise apparatus according to the present invention.

In FIG. 8, a plurality of foot support apertures (25) are engageable with a foot support base aperture (26) using a foot support adjustment pin (27), thereby providing means for adjusting the height of the foot support. Pin (28) secures the inner longitudinal member (11) to the foot support base (21) by simultaneously engaging aperture (29) and aperture (30).

Figure 9:
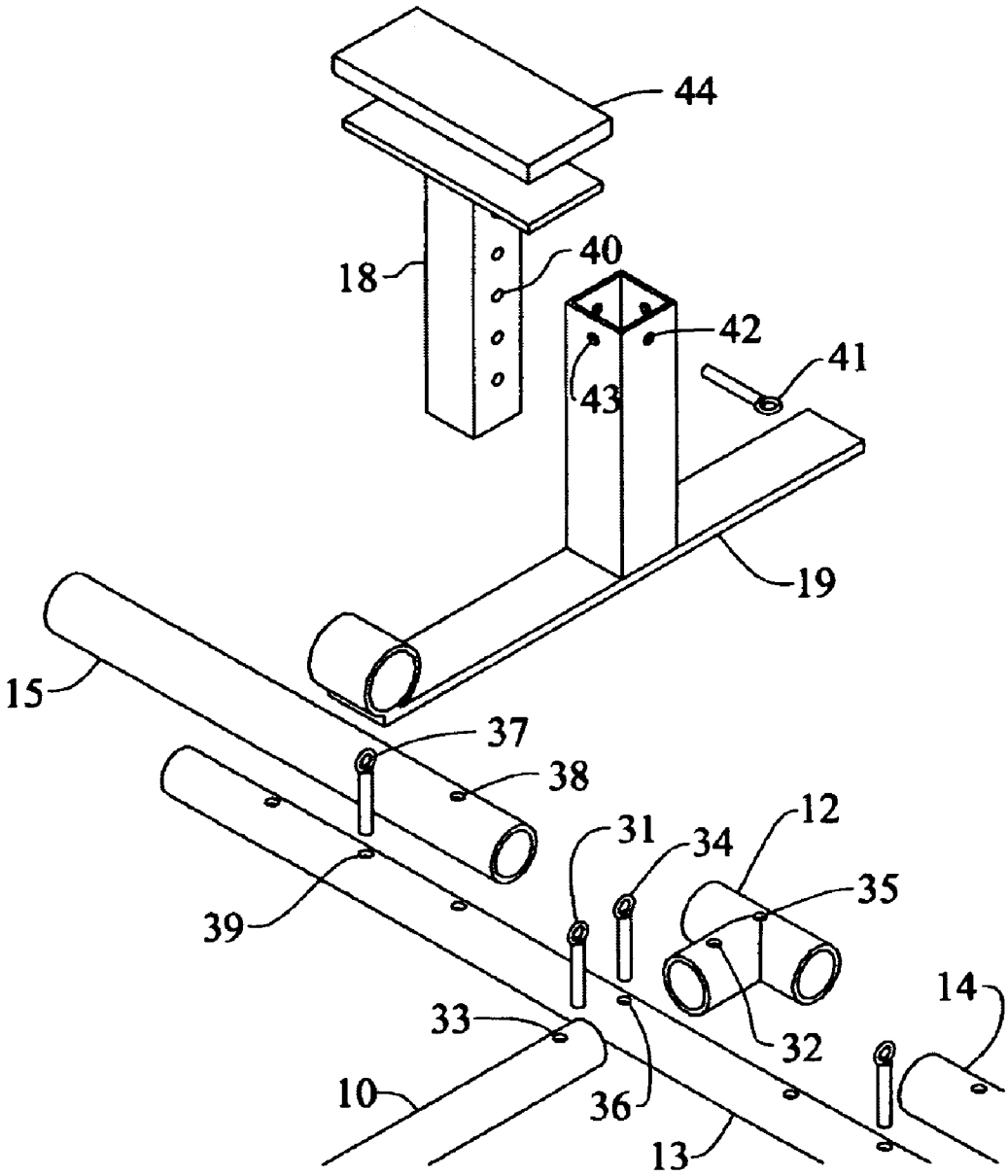
FIG. 9 is a close-up view of the separated components of the head end of an exercise apparatus according to the present invention.

In FIG. 9 the left hand components of the head section are shown unassembled. Pin (31) is used to join the outer longitudinal elongated member (10) to the T-connector (12) by engaging apertures (32) and (33). Pin (34) is used to join the lateral elongated member (13) to the T-connector (12) by engaging apertures (35) and (36). Pin (37) is used to adjustably join the left sleeve (15) with the lateral elongated member (13) by engaging aperture (38) and any one of a plurality of apertures (39) on the left side of the lateral elongated member (13). The left base (19) slides on the left sleeve (15) to provide additional lateral adjustment. The left hand support (18) has a plurality of apertures (40) that provide for vertical adjustment of the hand support when engaged with the left base (19) by means of pin (41). The left base has a first aperture (42) that allows the hand support to be oriented laterally and a second aperture (43) that allows the hand support to be oriented longitudinally. A left pad (44) cushions the user's hand, thereby providing comfort. The hand support base is extended longitudinally beyond the vertical axis of the hand support to provide stability. All of the above left hand components are duplicated on the right side.

When not in use, the exercise apparatus can be disassembled as in FIG. 7 for transportation or storage. When assembled for use, a multitude of adjustments are available to accommodate different users or different exercise routines. Telescoping inner and outer longitudinal tubes (10) and (11) provide length adjustment. Additional length adjustment is achieved by orienting the left and right hand support bases (19) and (18) to either face outward as in FIG. 1 or inward as in FIG. 2. Lateral adjustment of each hand support from the centerline of the apparatus is achieved by two different means that when used in combination, provide a wide range of lateral settings in a compact apparatus. The left sleeve (15) may be pinned to the left side of the lateral elongated member (13) in a plurality of positions. Additional lateral adjustment is achieved by sliding the left hand support base (19) laterally on the sleeve. The sliding action gives continuous rather than discrete adjustment thereby allowing an unlimited number of lateral settings. The right side of the apparatus functions in an analogous manner.

In the preferred embodiment, the hand supports (16) and (18) and foot support (20) are fabricated with elongated flat bars at the top. Pads of foam or other cushioning materials on the hand supports provide comfort and safety for the hands. The flat hand supports, as opposed to round tubes or bars, allow for more natural hand positions when performing push-ups. Since the hand supports are elevated, the user's fingers are able to curl and grip the underside of the hand support. Alternatively, the user's fingers may be outstretched as in a conventional push-up, or the fingers may be held in a relaxed, partially curved position.

The apparatus supports the user's body in a raised position, completely off the floor. The independent, vertical hand and foot adjustments allow the user to choose to have a positive or negative incline in the longitudinal direction and a right or left incline in the lateral direction. The range of adjustments on the hand and foot supports allow the user to do upper body presses as well as a variety of push-ups not possible on the floor, ground or similar flat surface.

Materials of construction for all components include metals, plastics, composites, and other structural materials. The components may be made of the same material, or different components of the same apparatus may be made different materials. A preferred material for a low cost, strong apparatus is steel. Aluminum is a preferred material for a strong, lightweight apparatus. Plastics and composites provide for a low cost and lightweight apparatus.

In a preferred embodiment, none of the components of the exercise apparatus has a maximum dimension of greater than thirty-six inches, thereby enhancing portability.

What is claimed is:

1. An exercise apparatus comprising:

a telescoping longitudinal member having a first end and a second end, a lateral member removably fixed to said first end of said telescoping longitudinal member, a foot support base removably fixed to said second end of said telescoping longitudinal member, a foot support adjustably engaged with said foot support base, a left hand support base adjustably engaged with said lateral member, a right hand support base adjustably engaged with said lateral member, a left hand support adjustably engaged with said left hand support base, a right hand support adjustably engaged with said right hand support base, wherein said left hand support base and said right hand support base are adapted to be engaged with said lateral member so that said left hand support and said right hand support are offset from the axis of said lateral member, thereby increasing the range of adjustment in the distance between the foot support and the hand supports.

2. The exercise apparatus of claim 1 wherein the heights of said left hand support, said right hand support, and said foot support are independently adjustable.

3. The exercise apparatus of claim 1 wherein none of the linear dimensions of the individual components exceeds thirty-six inches.

4. An exercise apparatus comprising:

a telescoping longitudinal member having a first end and a second end, a lateral member removably fixed to said first end of said telescoping longitudinal member, a foot support base removably fixed to said second end of said telescoping longitudinal member, a foot support adjustably engaged with said foot support base, a left sleeve and a right sleeve telescoping on said lateral member, a left hand support base adjustably engaged with said left sleeve, a right hand support base adjustably engaged with said right sleeve, a left hand support adjustably engaged with said left hand support base, a right hand support adjustably engaged with said right hand support base.

5. The exercise apparatus of claim 4 wherein said left hand support base and said right hand support base are adapted to be engaged with said left sleeve and said right sleeve so that said left hand support and said right hand support are offset from the axis of said lateral member, thereby increasing the range of adjustment in the distance between the foot support and the hand supports.

6. The exercise apparatus of claim 4 wherein the heights of said left hand support, said right hand support, and said foot support are independently adjustable.

7. The exercise apparatus of claim 4 wherein none of the linear dimensions of the individual components exceeds thirty-six inches.

8. The exercise apparatus of claim 5 wherein the heights of said left hand support, said right hand support, and said foot support are independently adjustable.

9. The exercise apparatus of claim 8 wherein none of the linear dimensions of the individual components exceeds thirty-six inches.

* * * * *